US008823629B2

(12) United States Patent
Bae et al.

(10) Patent No.: US 8,823,629 B2
(45) Date of Patent: Sep. 2, 2014

(54) DISPLAY DEVICE AND DRIVING METHOD OF DISPLAY DEVICE

(75) Inventors: Hyeon Seok Bae, Asan-si (KR); Gyu Ik Kim, Hwaseong-si (KR); Choong Seob Oh, Yongin-si (KR); Hoon Jung, Seoul (KR); Seung Hoon Han, Seoul (KR)

(73) Assignee: Samsung Display Co., Ltd. (KR)

( * ) Notice: Subject to any disclaimer, the term of this patent is extended or adjusted under 35 U.S.C. 154(b) by 189 days.

(21) Appl. No.: 13/427,147

(22) Filed: Mar. 22, 2012

(65) Prior Publication Data

US 2013/0113848 A1 May 9, 2013

(30) Foreign Application Priority Data

Nov. 4, 2011 (KR) ..... 10-2011-0114748

(51) Int. Cl.
*G09G 3/36* (2006.01)

(52) U.S. Cl.
USPC ..... 345/100; 345/99; 345/87; 345/691; 345/211; 345/690

(58) Field of Classification Search
USPC ..... 345/87, 691, 690, 204, 99–100, 92, 345/94–96, 208–213
See application file for complete search history.

(56) References Cited

U.S. PATENT DOCUMENTS

| | | | | |
|---|---|---|---|---|
| 6,714,461 | B2 | 3/2004 | Matsumoto et al. | |
| 6,903,589 | B2 | 6/2005 | Kim | |
| 7,035,148 | B2 | 4/2006 | Chung et al. | |
| 7,317,440 | B2 | 1/2008 | Chung | |
| 7,522,143 | B2 * | 4/2009 | Park et al. | 345/98 |
| 7,668,021 | B2 | 2/2010 | Yun | |
| 2003/0058375 | A1 * | 3/2003 | Moon et al. | 349/42 |
| 2004/0095342 | A1 * | 5/2004 | Lee et al. | 345/211 |
| 2007/0286481 | A1 * | 12/2007 | Monobe et al. | 382/169 |
| 2008/0266276 | A1 | 10/2008 | Choi et al. | |
| 2009/0122054 | A1 * | 5/2009 | Lee et al. | 345/214 |
| 2010/0060766 | A1 * | 3/2010 | Shoyama | 348/308 |

FOREIGN PATENT DOCUMENTS

| | | |
|---|---|---|
| JP | 2002367376 | 12/2002 |
| JP | 2002367676 | 12/2002 |
| JP | 4717582 | 4/2011 |
| KR | 1020040017157 | 2/2004 |
| KR | 100486254 | 4/2005 |
| KR | 100688567 | 2/2007 |
| KR | 100800192 | 1/2008 |
| KR | 1020080062936 | 7/2008 |

* cited by examiner

*Primary Examiner* — Shaheda Abdin

(74) *Attorney, Agent, or Firm* — Cantor Colburn LLP

(57) ABSTRACT

A method of driving a display device includes analyzing input data of the display device to confirm whether there is a predetermined image pattern in an image corresponding to the input data, where a common voltage is distorted to an extent that a clock signal for a gate driver of the display device is distorted when the display device displays the image including the predetermined image pattern, and changing a slew rate of an output buffer of a data driver of the display device based on a result of the analyzing the input data.

15 Claims, 7 Drawing Sheets

DISPLAY DEVICE AND DRIVING METHOD OF DISPLAY DEVICE

This application claims priority to Korean Patent Application No. 10-2011-0114748 filed on Nov. 4, 2011, and all the benefits accruing therefrom under U.S.C. §119, the content of which in its entirety is herein incorporated by reference.

BACKGROUND OF THE INVENTION (a) Field of the Invention

Exemplary embodiments of the invention relate to a display device and a driving method of the display device, and more particularly to a display device that is inversely driven and a driving method of the display device.

(b) Description of the Related Art

Liquid crystal display is one of the most widely used types of flat panel display. A liquid crystal display typically includes two display panels on which field generating electrodes such as pixel electrodes and a common electrode are disposed, and a liquid crystal layer that is interposed between the display panels. The liquid crystal display applies voltages to the field generating electrodes to generate an electric field in the liquid crystal layer, which determines the alignment of liquid crystal molecules of the liquid crystal layer and the polarization of incident light such that an image is displayed thereon. Also, the liquid crystal display is inversely driven to prevent deterioration of the liquid crystal layer. That is, grayscales are displayed using a positive voltage in some periods and a negative voltage in the other periods, and the grayscales are alternately applied such that degradation generated by rotating the liquid crystal molecules in one direction may be prevented.

Recently, a liquid crystal panel with reduced sized bezel has been developed to improve design and productivity efficiency of a substrate. In such a liquid crystal panel, a space margin of a wire for controlling a gate driver is reduced and a cell gap is decreased for fast response of the liquid crystal. In addition, the data voltage used is becoming gradually higher to obtain high transmittance.

Accordingly, in such a liquid crystal panel, the wire for controlling the gate driver and the common electrode of an upper substrate may overlap each other, and a capacitor is thereby formed such that the common voltage that is distorted due to a change of the data voltage affects the wire for controlling the gate driver such that a control signal for gate driving may be distorted and the gate driver may abnormally operate.

BRIEF SUMMARY OF THE INVENTION

Exemplary embodiments of the invention provide a driving method of a display device in which abnormal operation of a gate driver is effectively prevented by reducing an effect on a gate control wire when a data voltage is substantially changed.

In an exemplary embodiment, a driving method of a display device includes: analyzing input data of the display device to confirm whether there is a predetermined image pattern in an image corresponding to the input data, where a common voltage is distorted to an extent that a clock signal for a gate driver of the display device is distorted when the display device displays the image including the predetermined image pattern; and changing a slew rate of an output buffer of a data driver of the display device based on a result of the analyzing the input data.

In an exemplary embodiment, the analyzing the input data to confirm whether there is the predetermined image pattern in the image corresponding to the input data may include confirming whether adjacent pixels of the display device, which are adjacent to each other in a pixel row direction or a pixel column direction, have a grayscale difference greater than a predetermined grayscale when the display device displays the image.

In an exemplary embodiment, the confirming whether the adjacent pixels, which are adjacent to each other in the pixel row direction or the pixel column direction, have the grayscale difference greater than the predetermined grayscale when the display device displays the image may include using the following inequality: $|Gn(odd)-Gn(even)|>A$, where Gn(odd) denotes a gray value of an n-th data of the input data sequentially applied to an odd-numbered data line of two adjacent data lines of the display device, Gn(even) denotes a gray value of the n-th data of the input data sequentially applied to an even-numbered data line of the two adjacent data lines of the display device, and A denotes a gray value corresponding to the predetermined grayscale.

In an exemplary embodiment, the confirming whether the adjacent pixels of the display device, which are adjacent to each other in the pixel row direction or the pixel column direction, have the grayscale difference greater than the predetermined grayscale when the display device displays the image may further include using the following inequality: $|Gn(odd)-Gn-1(odd)|$ or $|Gn(even)-Gn-1(even)|>A$, where Gn−1(odd) denotes a gray value of an (n−1)-th data of the input data sequentially applied to the odd-numbered data line of the two adjacent data lines of the display device, and Gn−1(even) denotes a gray value of an (n−1)-th data of the input data sequentially applied to the even-numbered data line of the two adjacent data lines of the display device.

In an exemplary embodiment, the analyzing the input data to confirm whether there is the predetermined image pattern in the image corresponding to the input data may further include confirming whether a number of the adjacent pixels, which are adjacent to each other in the pixel row direction and have the grayscale difference greater than the predetermined grayscale, is greater than a predetermined number B.

In an exemplary embodiment, the analyzing the input data to confirm whether there is the predetermined image pattern in the image corresponding to the input data may further include confirming whether a number of the adjacent pixels, which are adjacent to each other in the pixel column direction and have the grayscale difference greater than the predetermined grayscale, is greater than a predetermined number C.

In an exemplary embodiment, the changing the slew rate of the output buffer of the data driver of the display device based on the result of the analyzing the input data may include lowering the slew rate of the output buffer of the data driver when the number of the adjacent pixels, which are adjacent to each other in the pixel row direction and have the grayscale difference greater than the predetermined grayscale, is greater than the predetermined number B and the number of the adjacent pixels, which are adjacent to each other in the pixel column direction and have the grayscale difference greater than the predetermined grayscale, is greater than the predetermined number C.

In an exemplary embodiment, a display device includes: a display area including a plurality of gate lines, a plurality of data lines and a plurality of pixels; a gate driver which applies a gate voltage to the gate lines; a data driver which applies a data voltage to the data lines and includes an output buffer; and a signal controller which controls the gate driver and the data driver, where the signal controller analyzes input data input from outside to confirm whether there is a predetermined image pattern in an image corresponding to the input data, where a common voltage is distorted to an extent that a clock signal for the gate driver is distorted when the image including the predetermined image pattern is displayed on the display area, and where the signal controller changes a slew rate of the output buffer of the data driver based on a result of analysis on the input data.

In an exemplary embodiment, the signal controller may confirm whether adjacent pixels of the pixels, which are adjacent to each other in a pixel row direction or a pixel column direction, have a grayscale difference greater than a predetermined grayscale when the display device displays the image.

In an exemplary embodiment, the signal controller may include: an input buffer which receives a gray data of the input data; a first condition calculator which receives the gray data from the input buffer and determines whether the adjacent pixels, which are adjacent to each other in the pixel row direction, have a grayscale difference greater than a predetermined gray; a second condition calculator which receives the gray data from the input buffer and determines whether the adjacent pixels, which are adjacent to each other in the pixel column direction, have a grayscale difference greater than the predetermined gray; an H-counter which counts a number of the adjacent pixels, which are adjacent to each other in the pixel row direction and have a grayscale difference greater than a predetermined grayscale, based on a result of the first condition calculator; a V-counter which counts a number of the adjacent pixels, which are adjacent to each other in the pixel column direction and have a grayscale difference greater than a predetermined grayscale, based on a result of the second condition calculator; and a slew rate determining unit which determines the slew based on the number counted by the H-counter and the number counted by the V-counter.

In an exemplary embodiment, the slew rate determining unit may decrease the slew rate when the number counted by the H-counter is greater than a predetermined B and the number counted by the V-counter is greater than a predetermined C.

In an exemplary embodiment, the signal controller may further include a line memory which receives the gray data from the first condition calculator and the second condition calculator and stores the gray data during a predetermined period.

In an exemplary embodiment, the line memory may transmit the stored gray data to the second condition calculator.

In an exemplary embodiment, the first condition calculator may calculate the following inequality: $|Gn(odd)-Gn(even)|>A$, where Gn(odd) denotes the gray data of an n-th data of the input data sequentially applied to an odd-numbered data line of two adjacent data lines of the data lines, Gn(even) denotes the gray data of the n-th data of the input data sequentially applied to an even-numbered data line of the two adjacent data lines of the data lines, and A denotes a gray value corresponding to the predetermined grayscale.

In an exemplary embodiment, the second condition calculator may calculate the following inequality: $|Gn(odd)-Gn-1(odd)|$ or $|Gn(even)-Gn-1(even)|>A$, where Gn−1(odd) denotes the gray data of an (n−1)-th data of the input data sequentially applied to the odd-numbered data line of the two adjacent data lines of the data lines, and Gn−1(even) denotes the gray data of an (n−1)-th data of the input data sequentially applied to the even-numbered data line of the two adjacent data lines of the data lines.

According to an exemplary embodiment of the invention, when it is determined that the image pattern corresponding to data voltages that is substantially changes is displayed in the display area, the slew rate is decreased when outputting the data voltage from the output buffer inside the data driver. In such an embodiment, the change of the data voltage is reduced such that the distortion degree of the common voltage is reduced, and the inference to the gate control wire of the gate driver is thereby reduced such that abnormal operation of the gate driver is effectively prevented.

BRIEF DESCRIPTION OF THE DRAWINGS

The above and other features will become more apparent by describing in further detail exemplary embodiments thereof with reference to the accompanying drawings, in which.

DETAILED DESCRIPTION OF THE INVENTION

Figure 1:
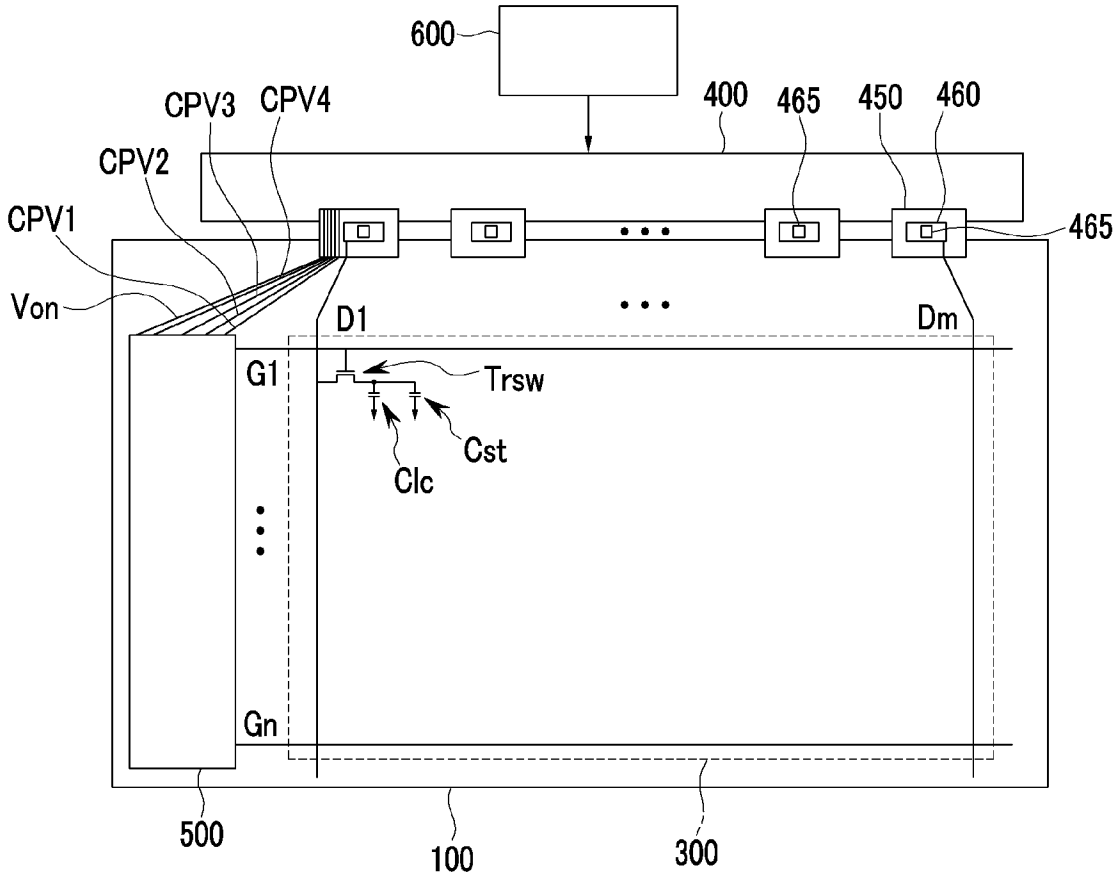
FIG. 1 is a block diagram showing an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of a display device according to the invention will be described with reference to the accompanying drawings.

Figure 2:
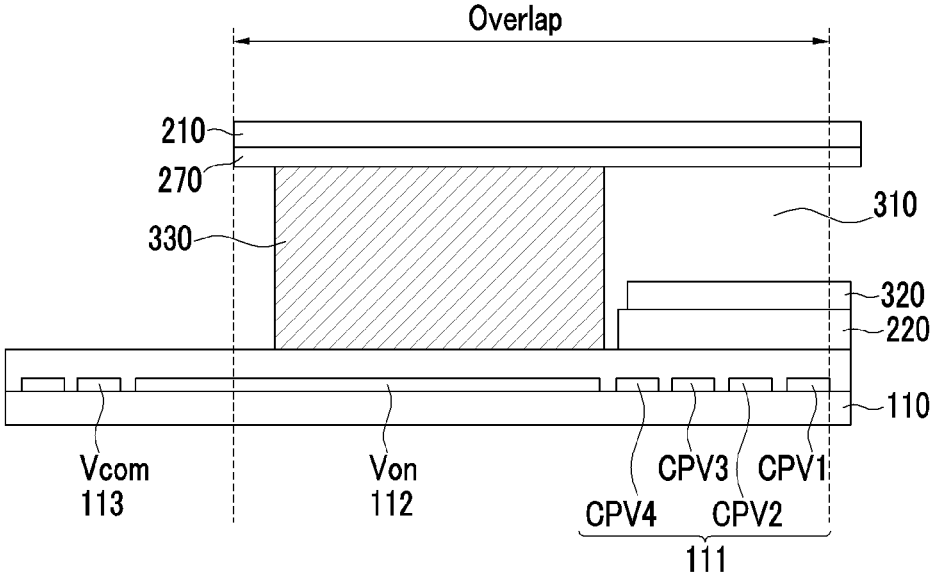
FIG. 2 is a partial cross-sectional view of an exemplary embodiment of a display device according to the invention.

FIG. 1 is a block diagram showing an exemplary embodiment of a display device according to the invention, and FIG. 2 is a partial cross-sectional view of an exemplary embodiment of a display device according to the invention.

Referring to FIG. 1, an exemplary embodiment of a display device includes a display panel 100, a film 450, e.g., a flexible printed circuit ("FPC") film, a printed circuit board ("PCB") 400, a data driver 460 and a signal controller 600. The display panel 100 includes a display area 300 for displaying images and a gate driver 500 that applies a gate voltage to a gate line of the display area 300. In an exemplary embodiment, as shown in FIG. 1, the gate driver 500 may be provided on the display panel 100, but not being limited thereto.

In an exemplary embodiment, a data line of the display area 300 is disposed on the film 450, e.g., the FPC film attached to the display panel 100, and the data line receives a data voltage from the data driver 460 including an output buffer 465.

The gate driver 500 and the data driver 460 are controlled by the signal controller 600. The PCB 400 is disposed outside the film 450, e.g., the FPC film, such that a signal from the signal controller 600 is transmitted to the data driver 460 and the gate driver 500 via the PCB 400. In an exemplary embodiment, a control signal is transmitted from the signal controller 600 to the gate driver 500 disposed on the display panel 100 through a side portion of film 450 positioned close to the gate driver 500 via the PCB 400.

In an exemplary embodiment, a gate driver control wire, which is connected between the signal controller 600 and the gate driver 500, transmits with a gate-on voltage Von and clock signals, e.g., a first clock signal CPV1, a second clock signal CPV2, a third clock signal CPV3 and a fourth clock signal CPV4. In an alternative exemplary embodiment, the gate driver control wire may transmit other signals including the clock signals. In an exemplary embodiment, one or two clock signals may be applied to the gate driver 500. In one exemplary embodiment, for example, four clock signals may be applied to the gate driver 500.

In an exemplary embodiment, the display panel 100 is a liquid crystal panel such that the display area 300 includes a plurality of pixels. In an exemplary embodiment the pixels may be substantially in a matrix form, which include a pixel row and a pixel column.

In such an embodiment, each of the pixels includes a thin film transistor Trsw, a liquid crystal capacitor Clc and a storage capacitor Cst. The thin film transistor Trsw includes a control terminal connected to a corresponding gate line, an input terminal connected to a corresponding data line, and an output terminal connected to a first terminal of the liquid crystal capacitor Clc, which may be a pixel electrode (not shown), and a first terminal of the storage capacitor Cst, which may be a pixel electrode (not shown). A second terminal of the liquid crystal capacitor Clc is connected to a common electrode 270 on an upper substrate, and a second terminal of the storage capacitor Cst is connected to the storage electrode (not shown), which receives a storage voltage.

The display area 300 includes a plurality of gate lines, e.g., first to n-th gate lines G1 to Gn, and a plurality of data lines, e.g., first to m-th data line D1 to Dm, and the gate lines G1 to Gn and the data lines D1 to Dm are insulated from each other and crossing each other.

The gate lines G1 to Gn sequentially receives a gate-on voltage Von from the gate driver 500. The gate driver 500 applies the gate-on voltage Von to a corresponding gate line at a predetermined time using the clock signals CPV1, CPV2, CPV3 and CPV4 and the gate-on voltage Von, which are applied from the signal controller 600.

In an exemplary embodiment, the clock signals CPV1, CPV2, CPV3 and CPV4 and the gate-on voltage Von are applied to the gate driver 500 through the film 450, such as the FPC film provided outside the display area 300 of the display panel 100 at a left side of the gate driver 500, as shown in FIG.

1. The clock signals CPV1, CPV2, CPV3 and CPV4 and the gate-on voltage Von are generated from outside or the signal controller 600, and then are transmitted to the gate driver 500 through the PCB 400 and the film 450, such as the FPC film.

In an exemplary embodiment, the gate driver control wire, which transmits the clock signals CPV1, CPV2, CPV3 and CPV4 and the gate-on voltage Von, extends in an oblique direction, as shown in FIG. 1. In an alternative exemplary embodiment, the gate driver control wire may have a bent structure, e.g., an L-like shape, and may be disposed along an outer portion of the display panel 100.

In an exemplary embodiment, the data lines D1 to Dm receive a data voltage from the data driver 460.

In an exemplary embodiment, as shown in FIG. 1, the data driver 460 is disposed at an upper side of the display panel 100 and is connected to the data lines D1 to Dm extending in a longitudinal direction. In an alternative exemplary embodiment, the data driver 460 may be disposed at a lower side of the display panel 100. The data driver 460 includes the output buffer 465, and the output buffer 465 temporally stores the data voltage and outputs the stored data voltage to the data lines D1 to Dm at a predetermined timing, and the output buffer 465 applies the data voltage with a predetermined slew rate. In an exemplary embodiment, the slew rate may be controlled based on an image pattern, which is a pattern of an image pattern to be displayed on the display area 300, and an exemplary embodiment of a method of driving a display device using the slew rate control will be described later in greater detail with reference to FIGS. 6 and 7.

Next, a cross-sectional view of an outer portion of the display panel 100 including the gate driver control wire will be described with reference to FIG. 2.

The cross-sectional view shown in FIG. 2 shows an outer portion of the display panel 100 including the gate driver control wires 111 and 112 connected to the gate driver 500 and a sealant 330.

As shown in FIG. 2, the display panel 100 includes an upper substrate 210 and a lower substrate 110. In an exemplary embodiment, the lower substrate 110 includes the gate lines G1 to Gn, the data lines D1 to Dm, the thin film transistor Trsw and the pixel electrode (not shown). In such an embodiment, the gate driver control wires 111 and 112 and a common voltage transmission wire 113 are disposed in an area outside the display area 300, and a light blocking member 220 and a spacer 320 are disposed in the area.

The upper substrate 210 includes the common electrode 270 disposed covering substantially an entire surface of the upper substrate 210.

A liquid crystal layer including liquid crystal molecules 310 is disposed between the upper substrate 210 and the lower substrate 110, and the sealant 330, which seals the liquid crystal molecules 310 and attaches the upper substrate 210 and the lower substrate 110, encloses a peripheral area of the display area 300. The common voltage transmission wire 113 formed at the lower substrate 110 does not overlap the upper substrate 210, and a common voltage is applied to the common electrode 270 of the upper substrate 210 via the sealant 330.

In an exemplary embodiment, the gate driver control wires includes a clock signal wire 111 and a gate-on voltage wire 112, which may overlap the common electrode 270 of the upper substrate 210 such that a parasitic capacitance may occur therebetween. In an exemplary embodiment, the gate driver control wire may transmit various control signals, and the number of clock signal wires 111 may vary. In an exemplary embodiment, as shown in FIGS. 1 and 2, the clock signal wires 111 may be applied with four clock signals CPV1, CPV2, CPV3 and CPV4, which are signals having a level continuously repeating between a high level and a low level. In an exemplary embodiment a capacitance may occur between the clock signal wires 111 and the common electrode 270 such that the clock signal wires 111 may be affected by a change in the common voltage Vcom applied to the common electrode 270. In an exemplary embodiment, when the clock signals CPV1, CPV2, CPV3 and CPV4 are changed, the timing of outputting the gate-on voltage from the gate driver 500 is changed such that abnormal operation may occur.

In an exemplary embodiment, when the common voltage Vcom at the common electrode 270 is changed, the gate driver control wires, which overlaps the common electrode 270 (e.g., the clock signal wires 111), are affected by the change in the common voltage at the common electrode 270 such that abnormal operation of the gate driver 500 may occur.

Hereinafter, a relationship between common voltage and a clock signal will be described referring to FIG. 3.

Figure 3:
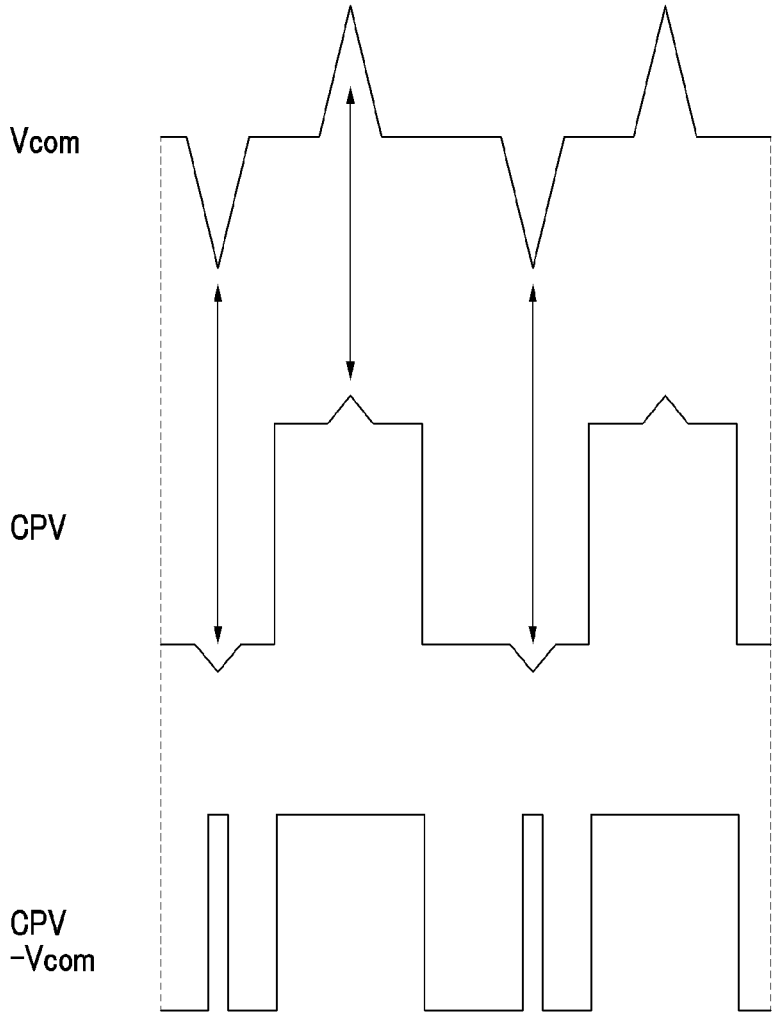
FIG. 3 is a signal timing diagram showing a clock signal, a common voltage and a change of a difference between two voltages according thereto when changing the level of a data voltage.

FIG. 3 is a graph showing a clock signal CPV, a common voltage Vcom and a change of a difference between the clock signal and the common voltage CPV-Vcom when the level of the data voltage changes. FIG. 3 shows a change of the clock signal CPV according to a change of the common voltage Vcom, and a clock signal recognized at the gate driver 500.

In an exemplary embodiment, as shown in FIG. 3, the level of the common voltage Vcom at the common electrode 270, which receives a constant voltage, may change according to the change of the data voltage. In FIG. 3, the common voltage Vcom at the common electrode 270 that is actually measured is shown with simplification.

The clock signal CPV overlapping the common electrode 270, the common voltage Vcom at which is distorted, is also distorted corresponding to distortion timing of the common voltage Vcom, as shown by the arrows of FIG. 3, because of the capacitance between the common electrode 270 and the clock signal wires 111, which overlap each other. In an exemplary embodiment, the degree of distortion of the clock signal CPV is less than the distortion degree of the common voltage Vcom.

In an exemplary embodiment, the gate driver 500 determines whether the input signal is high or low to recognize the input clock signal CPV based on a potential difference between the common voltage Vcom and the input clock signal CPV. In an exemplary embodiment, as shown in FIG. 3, the clock signal that may be distorted such that the difference between the clock signal and the common voltage CPV-Vcom is recognized at the gate driver 500. In such an embodiment, a waveform of the difference between the clock signal and the common voltage CPV-Vcom may be shown as in FIG. 3 because the magnitude of a noise due to decreases of the common voltage Vcom is higher than a threshold voltage in the gate driver 500. In an exemplary embodiment, as described above, the distorted clock signal may be recognized at the gate driver 500 such that the gate-on voltage may not be timely output, and the abnormal operation thereby occurs.

In an exemplary embodiment, the distortion at the common voltage Vcom of the common electrode 270 may occur due to the change of the data voltage applied to the pixel electrode. In an exemplary embodiment, where the data voltage is inversely driven with respect to the common voltage Vcom, the data voltage may be biased when a specific pattern is displayed, and the common voltage Vcom is thereby distorted.

Hereinafter, a distortion of the common voltage Vcom according to the change of the data voltage will be described with reference to FIGS. 4 and 5.

Figure 4:
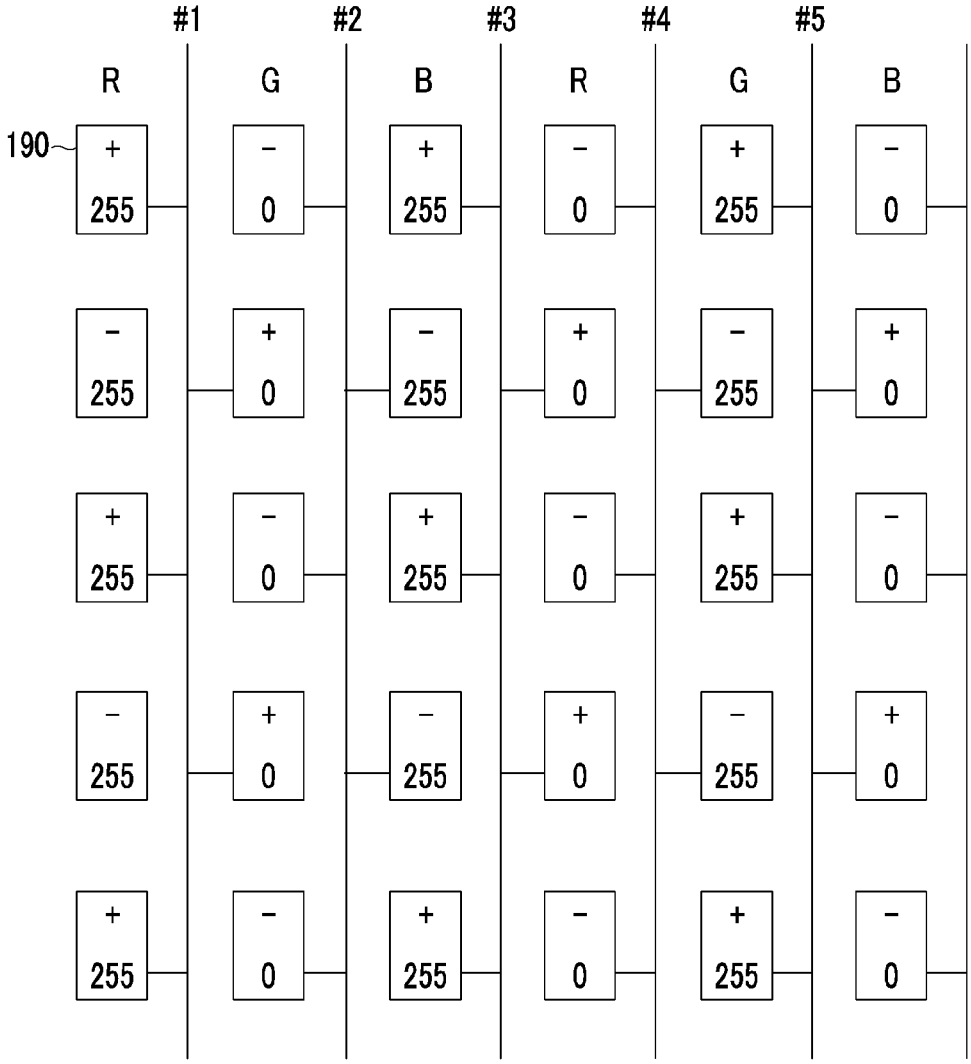
FIG. 4 is a plan view of a pattern of a data voltage applied to an exemplary embodiment of a display device.
Figure 5:
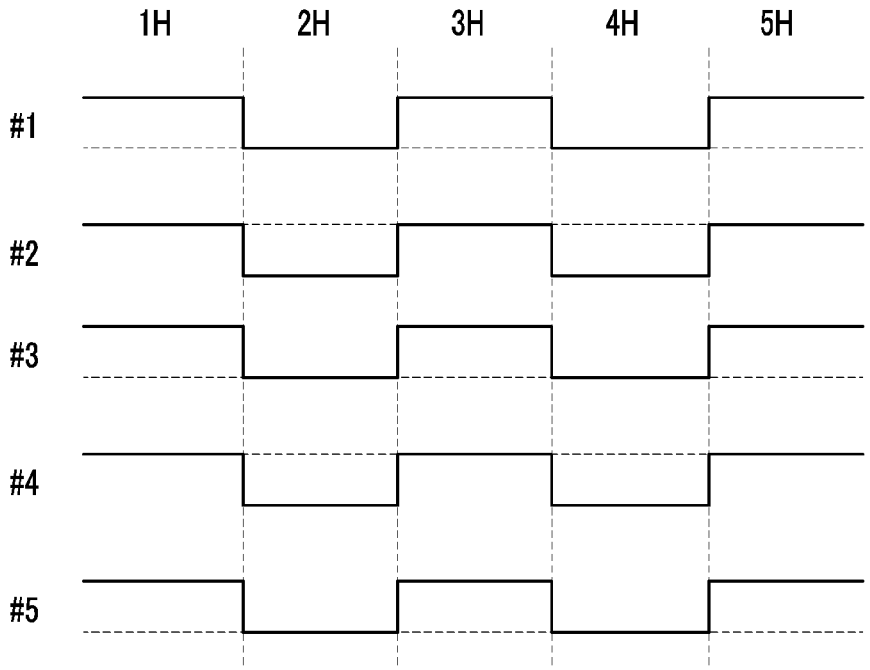
FIG. 5 is a signal timing diagram showing a change of a data voltage applied to an exemplary embodiment of a display device.

FIG. 4 is a plan view of a pattern of a data voltage applied to an exemplary embodiment of a display device, and FIG. 5 is a signal timing diagram showing a change of a data voltage applied to an exemplary embodiment of a display device. In FIG. 4, the reference number "190" of the quadrangle denotes the pixel electrode, the number written inside of the quadrangle represents the displayed grayscale, and (+) or (−) inside of the quadrangle represent a polarity of the data voltage applied to the pixels, e.g., a positive data voltage or a negative data voltage.

In an exemplary embodiment, as shown in FIG. 4, a pixel includes red (R), green (G) and blue (B) subpixels, and subpixels in a pixel column represent a same color. In an exemplary embodiment, a data line is disposed between two neighboring pixel columns and alternately connected to the subpixels in the two neighboring pixel columns such that the data line is connected to neighboring pixels with a zigzag pattern. In such an embodiment, where the display panel having the alternating arrangement, the image to be displayed by the display panel may have a pattern (e.g., an image pattern of FIG. 4), in which a pixel column that displays a maximum luminance corresponding to a maximum gray (e.g., a gray of 255) and a pixel column that displays a minimum luminance (e.g., zero gray or black) are alternately arranged along a pixel row direction, as shown in FIG. 4. In such an embodiment, the voltage applied to data lines of FIG. 4 (e.g., the data line #1, the data line #2, the data line #3, the data line #4 and the data line #5) may be changed as shown in FIG. 5.

When the display panel displays the image pattern of FIG. 4, the change of the voltage applied to a data line is substantially large, as shown in FIG. 5. In an exemplary embodiment, the data voltage in a first horizontal period 1H of FIG. 5 has a positive polarity such that the common voltage Vcom is substantially distorted to the positive value, and the data voltage in a second horizontal period 2H of FIG. 5 has a negative data voltage such that the common voltage Vcom is distorted to the negative value. In such an embodiment, the distortion of the common voltage Vcom may be continuously swinging according to a time.

When the image pattern of FIG. 4 is displayed on the display panel including data lines connected to the pixels with the alternating arrangement, the distortion of the common voltage Vcom may occur, and the clock signal CPV is thereby distorted, as shown in FIG. 3, such that an error may occur in the gate driver 500.

In an exemplary embodiment, a slew rate of outputting the data voltage is controlled, e.g., decreased, in the output buffer 465 of the data driver 460, and the distortion that occurs in the common voltage Vcom is substantially reduced by the decreased slew rate.

In an exemplary embodiment, the distortion may occurs in the common voltage Vcom by the capacitance between the common electrode 270 and the pixel electrode 190, and this may be represented by Equation 1 below.

$$I = C\frac{dv}{dt} \qquad \text{[Equation 1]}$$

In Equation 1, C denotes the capacitance between the common electrode 270 and the pixel electrode 190, I denotes the current flowing in the liquid crystal capacitor including the common electrode and the pixel electrode, and dv/dt denotes a derivative of voltage with respect to time, representing a variation of voltage difference between the common electrode 270 and the pixel electrode 190 during a unit time.

In Equation 1, when the current I rapidly increases, the common voltage Vcom decreases. In Equation 1, when the current I rapidly decreases, the common voltage Vcom rapidly increases. The change of the voltage during the unit time period may be decreased by reducing the current I, which causes the change of the common voltage Vcom, according to Equation 1.

In an exemplary embodiment, the change of the voltage per unit time decreases as the slew rate in the output buffer 465 of the data driver 460 increases, and the distortion that occurs in the common voltage Vcom is substantially reduced by increasing the slew rate of the output buffer 465. In such an embodiment, distortion of the clock signal CPV may be effectively prevented such that the gate driver 500 is substantially normally operated.

An exemplary embodiment of a method of driving a display device will be described in detail with reference to FIGS. 6 and 7.

Figure 6:
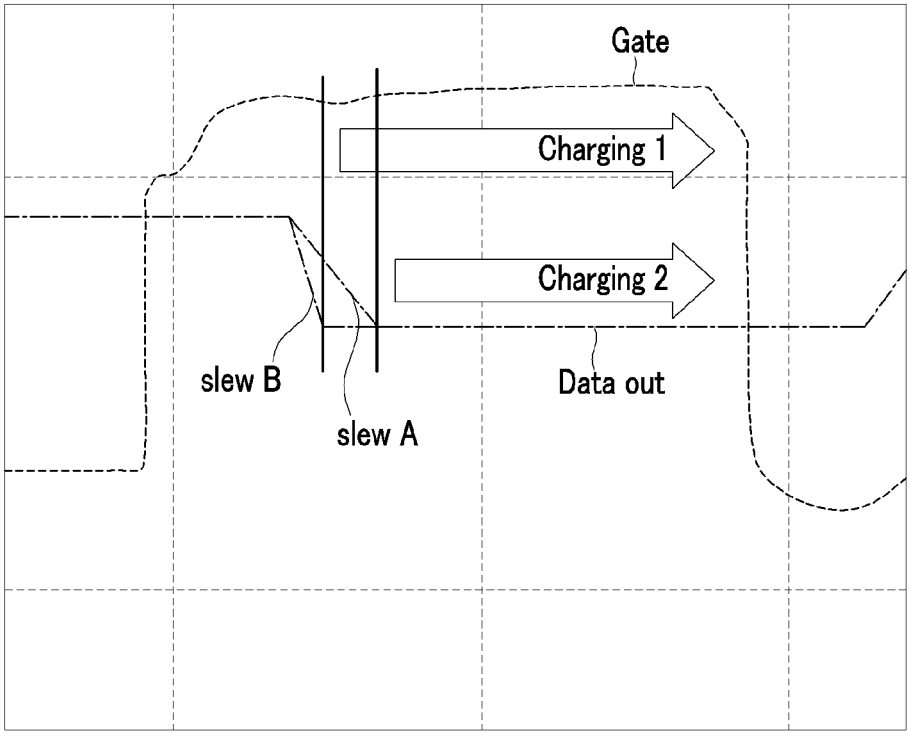
FIG. 6 is a waveform diagram showing a difference of a charging rate of the display area with respect to the change of the slew rate of the output buffer of the data driver.
Figure 7:
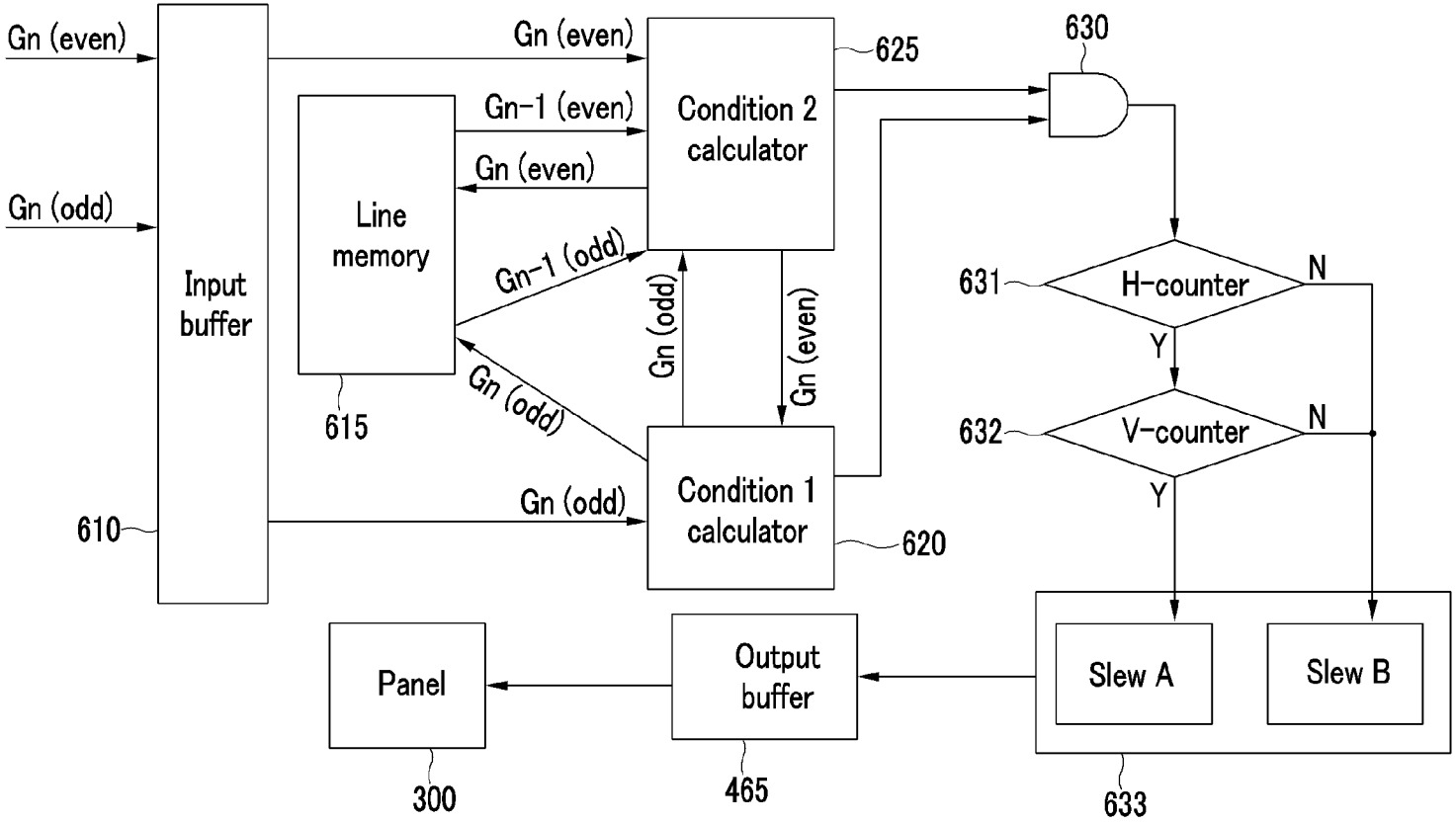
FIG. 7 is a block diagram showing an exemplary embodiment of a method of driving a display device according to the invention.

FIG. 6 is a waveform diagram showing a difference of a charging rate of the display area with respect to the change of the slew rate of the output buffer of the data driver, and FIG. 7 is a block diagram showing an exemplary embodiment of a method of driving a display device according to the invention.

In FIG. 6, a difference of a charging rate with respect to the change of the slew rate is shown using a waveform diagram of the voltage.

In an exemplary embodiment, the image pattern displayed on the display area 300 is analyzed, and the slew rate of the output buffer 465 of the data driver 460 is changed based on the analysis on the image pattern. In FIG. 6, the difference of the charging rate of the display area 300 corresponding to different slew rates is shown.

In an exemplary embodiment, the data voltage relatively rapidly reaches a target data voltage in a state where the gate-on voltage is applied which a high slew rate (indicated by "slew B" in FIG. 6) such that the pixel is charged during a first time, as indicated by the arrow "Charging 1" of FIG. 6. In such an embodiment, the data voltage reaches the target data voltage relatively slowly in with a low slew rate (indicated by "slew A" in FIG. 6) such that the pixel is charged during a second time, which is shorter than the first time, as indicated by the arrow "Charging 2" of FIG. 6.

In an exemplary embodiment, the slew rate of the output buffer 465 of the data driver 460 may be substantially high. In such an embodiment, as shown in FIG. 3 to FIG. 5, the slew rate is reduced when the data voltage that distorts the common voltage is output from the data driver 460 such that the gate driver 500 substantially normally operates.

Hereinafter, an exemplary embodiment of a method of driving a display device, in which the slew rate is controlled, will be described with reference to FIG. 7.

In an exemplary embodiment, as shown in FIG. 7, the input data is analyzed to determine the image pattern, and the slew rate is thereby changed to a value of "Slew A" or is maintained as a value of "Slew B," which is greater than "Slew A". In such an embodiment, the method of analyzing the input data includes a method of determining a number of adjacent pixels, which are adjacent each other (along the pixel row direction or pixel column direction) and have grayscale difference greater than a predetermined value, in an image of a same frame.

According to FIG. 7, the input data from outside is divided into data (hereinafter referred to as an "odd data") applied to an odd-numbered data line (hereinafter referred to an "odd data line") and data (hereinafter referred to as an "even data") applied to the even-numbered data line (hereinafter referred to as an "even data line"). In FIG. 7, "even" means the even data line and "odd" means the odd data line. In FIG. 7, G(n) indicates an n-th gray data, and G(n−1) indicates an (n−1)-th gray data, that is input earlier than the n-th data. In an exemplary embodiment, the n-th gray data is referred to as the gray data applied to the pixels disposed in an n-th pixel row, the (n−1)-th gray data is the gray data applied to the pixels disposed in the (n−1)-th pixel row.

In an exemplary embodiment, the data driver 460 or the signal controller 600 may perform the calculation in FIG. 7. In an alternative exemplary embodiment, the display device may further include an additional driver for the calculation. Hereafter, an exemplary embodiment in which the calculation is performed in the signal controller 600 will be described for convenience of description.

A condition 1 calculator 620 and a condition 2 calculator 625 in FIG. 7 are portions that calculate and determine a condition 1 and a condition 2, respectively. In an exemplary embodiment, the adjacent pixels, which are adjacent each other (along the pixel row direction or pixel column direction) and have grayscale difference greater than a grayscale corresponding to the predetermined value, in a same frame may be detected based on a result of the calculation in the condition 1 calculator 620 and the condition 2 calculator 625.

In an exemplary embodiment, the condition 1 calculator 620 and the condition 2 calculator 625 may detect the adjacent pixels in the display panel including data lines having non-alternating arrangement, in which only one data line is connected to the pixels disposed one side thereof among the neighboring pixels thereof, and may detect the adjacent pixels in the display panel including data lines having the alternating arrangement of FIG. 4.

In an exemplary embodiment, the gray data of the input data are divided into the gray data Gn(odd) (referred to as "odd gray data") of the odd data line and the gray data Gn(even) (referred to as "even gray data") of the even data line from outside the signal controller 600, and input to an input buffer 610 of the signal controller 600.

In an exemplary embodiment, the input buffer 610 transmits the odd gray data Gn(odd) and the even gray data Gn(even) to the condition 1 calculator 620 and the condition 2 calculator 625, respectively. In such an embodiment, the condition 1 calculator 620 and the condition 2 calculator 625 exchange the odd gray data Gn(odd) and the even gray data Gn(even) input thereto such that the condition 1 calculator 620 and the condition 2 calculator 625 receive all of the odd gray data Gn(odd) and the even gray data Gn(even), output from the input buffer 610.

In an exemplary embodiment, the condition 1 calculator 620 and the condition 2 calculator 625 may transmit the odd gray data Gn(odd) and the even gray data Gn(even) to a line memory 615, which stores gray data, e.g., the odd gray data Gn(odd) and the even gray data Gn(even), during a predetermined period (for example, during a unit horizontal period). The gray data stored in the line memory 615 during the predetermined period, which is "odd gray data and even gray data of a previous frame Gn−1(odd) and Gn−1(even)" in FIG. 7, is transmitted to the condition 2 calculator 625, and is calculated along with the gray data (odd gray data Gn(odd) and the even gray data Gn(even)) of a current frame. In an exemplary embodiment, as shown in FIG. 7, the gray data stored in the line memory 615 is transmitted to the condition 2 calculator 625 such that the gray data stored to the line memory 615 is used in the condition 2 calculator. In an alternative exemplary embodiment, the gray data stored in the line memory 615 may be transmitted to the condition 1 calculator 620.

In an exemplary embodiment, as shown in FIG. 7, the condition 1 may be used to identify the pixels disposed adjacent to each other along the pixel row direction and having a grayscale difference greater than the predetermined gray (gray value of A) in the display area 300, and the condition 2 may be used to identify the pixels disposed adjacent to each other along the pixel column direction and having a grayscale difference greater than the predetermined grayscale (gray value of A) in the display area 300.

In an exemplary embodiment, the condition 1 calculated in the condition 1 calculator 620 may be expressed by Inequality 1 below.

$$|Gn(\text{odd})-Gn(\text{even})|>A \qquad \text{[Inequality 1]}$$

In Inequality 1, "Gn(odd)" denotes the n-th data of the gray data sequentially applied to an odd data line of two adjacent data lines, "Gn(even)" denotes the n-th data of the gray data sequentially applied to an even data line of the two adjacent data lines, and "A" denotes a gray value corresponding to the predetermined grayscale.

In the condition 1 calculator 620, the data applied to the pixels adjacent to each other along the pixel row direction and connected to the two adjacent data lines are compared with each other to determine whether the difference between the grayscale of the pixels are greater than A. In such an embodiment, it is determined whether the difference between the display grayscales of the pixels that are adjacent to each other in the pixel row direction is greater than the gray value of A, which is predetermined. In Inequality 1, the gray data applied to the even data line are compared with the gray data of the odd data line adjacent thereto in the pixel row direction, and the gray data applied to the odd data line are compared with the gray data of the even data line adjacent thereto in the pixel row direction.

In an exemplary embodiment, the condition 2 calculated in the condition 2 calculator 625 may be expressed by Inequality 2 below.

$$|Gn(\text{odd})-Gn-1(\text{odd})| \text{ or } |Gn(\text{even})-Gn-1(\text{even})|>A \qquad \text{[Inequality 2]}$$

In Inequality 2, "Gn(odd)" and "G−1(odd)" denote the n-th data and the (n−1)-th data, respectively, of the gray data sequentially applied to an odd data line of two adjacent data lines, "Gn(even)" and "Gn−1(even) denote the n-th data and the (n−1)-th data, respectively, of the gray data sequentially applied to an even data line of the two adjacent data lines, and "A" denotes a gray value corresponding to the predetermined grayscale.

In such an embodiment, the condition 2 calculator 625 compares the gray data sequentially applied to a same data line to calculate whether the difference between the gray data is greater than the gray value of A, that is, it is determined whether the grayscale difference between the pixels, which are adjacent to each other in the pixel column direction and connected to the same data line, is greater than the gray value of A. In such an embodiment, the condition 2 is calculated based on gray data for the same data line. In such an embodiment, the value A is predetermined value and is substantially the same as the predetermined value (the gray value A) used in the condition 1 calculator 620. In an alternative exemplary embodiment, the value A used in the calculation of the condition 1 may be differently from the value A used in the calculation of the condition 2.

In an exemplary embodiment, the results of calculation based on the Inequality 1 and Inequality 2 in the condition 1 calculator 620 and the condition 2 calculator 625 are transmitted to an AND calculator 630, and then the slew rate is determined in a slew rate determining unit 633 based on output from an H-counter 631 and a V-counter 632.

In an exemplary embodiment, a number of adjacent pixels that satisfy the condition 1 is counted in the H-counter 631, and when the counted number in the H-counter 631 is greater than a number B, the calculated result is moved into Y, while when the counted number is less than the number B, the calculated result is moved into N.

In an exemplary embodiment, a number of adjacent pixels that satisfy the condition 2 is counted in the V-counter 632, and when the counted number in the V-counter 623 is greater than C, the calculated result is moved into Y, and when the counted number is less than C, the calculated result is moved into N. The count operation of the V-counter 632 is performed when the counted number in the H-counter 631 is greater than the number B. Here, the numbers B and C are values predetermined based on a characteristic of the display device.

In an exemplary embodiment, as shown in FIG. 7, when the number of pixels, which are adjacent to each other in the pixel column direction and having grayscale difference greater than the predetermined gray value, is greater than B, and the number of pixels, which are adjacent to each other in the pixel row direction and grayscale difference greater than the predetermined gray value, is greater than C, the slew rate determining unit 633 outputs the slew value A, which is less than the slew value B, to reduce the slew value of the output buffer. In such an embodiment, the change of the data voltage becomes slow with the slew rate corresponding to the slew value A such that the common voltage Vcom at the common electrode is less affected. In such an embodiment, when the numbers counted in the H-counter 631 and the V-counter 632 are less than B and C, respectively, the slew value B is output by the slew rate determining unit 633 to increase the slew rate of the output buffer such that the change of the data voltage is substantially rapid to have an increased charging time.

As described above, the condition 1 and the condition 2 are calculated and the number thereof is counted in the signal controller 600 such that the slew value determined in the slew rate determining unit 633 is transmitted to the output buffer 465 of the data driver 460 to output the data voltage with the corresponding slew value to the display area 300 of the display panel.

In an exemplary embodiment, as shown in FIG. 7, the input buffer 610, the line memory 615, the condition 1 calculator 620, the condition 2 calculator 625, the AND calculator 630, the H-counter 631, the V-counter 632 and the slew rate determining unit 633 are included in the signal controller 600. In an alternative exemplary embodiment, and the input buffer 610, the line memory 615, the condition 1 calculator 620, the condition 2 calculator 625, the AND calculator 630, the H-counter 631, the V-counter 632 and the slew rate determining unit 633 may be disposed in the data driver 460.

In an exemplary embodiment, as shown in FIG. 7, the signal controller 600 includes the input buffer 610 that receives the gray data from outside, the first condition calculator 620 that receives the gray data from the input buffer 610 and calculates whether the adjacent pixels in the display area 300, which are adjacent to each other in the pixel row direction, have gray difference greater than the gray value of A, the second condition calculator 625 that receives the gray data from the input buffer 610 and calculates whether the adjacent pixels in the display area 300, which are adjacent to each other in the pixel column direction, have grayscale difference greater than the gray value of A, the H-counter 631 that counts the number of the adjacent pixels based on the result of the first condition calculator 620, the V-counter 632 that counts the number of the adjacent pixels based on the result of the second condition calculator 620, and the slew rate determining unit 633 that determines the slew rate based on the results of the H-counter 631 and the V-counter 632.

In such an embodiment, the slew rate determining unit 633 decreases the slew rate when the number counted by the H-counter 631 is greater than the predetermined number B and the number counted by the V-counter 632 is greater than the predetermined number C.

In an exemplary embodiment, the signal controller 600 of FIG. 7 further includes the line memory 615 that stores the gray data during a predetermined period after the transmission of the gray data from the first condition calculator 620 and the second condition calculator 625, and the AND calculator 630 that sums the calculation result of the first condition calculator 620 and the second condition calculator 625. In an exemplary embodiment, as shown in FIG. 7, the line memory 615 transmits the stored gray data to the second condition calculator 625.

In an exemplary embodiment, as shown in FIG. 7, it is determined how many adjacent pixels of all of the adjacent pixels in the display area 300 satisfy the condition 1 and the condition 2, and then the slew value is changed based on the determination.

In an exemplary embodiment, as shown in FIG. 7, the number of adjacent pixels having a grayscale difference greater than a predetermined grayscale is counted. In an alternative exemplary embodiment, the slew value of the output buffer 465 is decreased when it is determined that the data voltage is changed to an extent that the gate driver clock signal is distorted by a distorted common voltage.

In an exemplary embodiment of the invention, it is determined whether the common voltage Vcom is distorted based on an analysis on the image pattern to be displayed in the display area 300, e.g., whether the image pattern displayed in the display area 300 is corresponding to a predetermined image pattern, which may lead to the distortion of the common voltage Vcom. In an exemplary embodiment, the condition 1 and the condition 2 of FIG. 7 are used to analyze the image patter to be displayed. However, the invention is not limited to the illustrated exemplary embodiments. In an alternative exemplary embodiment, the slew rate may be decreased in the output buffer 465 of the data driver 460 when the distortion of the common voltage is detected.

In an exemplary embodiment, as shown in FIG. 7, the slew rate determining unit 633 selects one of two slew rates, e.g., Slew A and Slew B. In an alternative exemplary embodiment, the slew rate may be calculated through a predetermined calculation in the slew rate determining unit 633.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of driving a display device, the method comprising:

analyzing input data of the display device to confirm whether there is a predetermined image pattern in an image corresponding to the input data, wherein a common voltage is distorted to an extent that a clock signal for a gate driver of the display device is distorted when the display device displays the image including the predetermined image pattern; and changing a slew rate of an output buffer of a data driver of the display device based on a result of the analyzing the input data.

2. The method of claim 1, wherein the analyzing the input data to confirm whether there is the predetermined image pattern in the image corresponding to the input data comprises:

confirming whether adjacent pixels of the display device, which are adjacent to each other in a pixel row direction or a pixel column direction, have a grayscale difference greater than a predetermined grayscale when the display device displays the image.

3. The method of claim 2, wherein the confirming whether the adjacent pixels, which are adjacent to each other in the pixel row direction or the pixel column direction, have the grayscale difference greater than the predetermined grayscale when the display device displays the image comprises:

using the following inequality:

$$|Gn(\text{odd})-Gn(\text{even})|>A,$$

wherein Gn(odd) denotes a gray value of an n-th data of the input data sequentially applied to an odd-numbered data line of two adjacent data lines of the display device, Gn(even) denotes a gray value of the n-th data of the input data sequentially applied to an even-numbered data line of the two adjacent data lines of the display device, and A denotes a gray value corresponding to the predetermined grayscale.

4. The method of claim 3, wherein the confirming whether the adjacent pixels of the display device, which are adjacent to each other in the pixel row direction or the pixel column direction, have the grayscale difference greater than the predetermined grayscale when the display device displays the image further comprises:

using the following inequality:

$$|Gn(\text{odd})-Gn-1(\text{odd})| \text{ or } |Gn(\text{even})-Gn-1(\text{even})|>A,$$

wherein Gn−1(odd) denotes a gray value of an (n−1)-th data of the input data sequentially applied to the odd-numbered data line of the two adjacent data lines of the display device, and Gn−1(even) denotes a gray value of an (n−1)-th data of the input data sequentially applied to the even-numbered data line of the two adjacent data lines of the display device.

5. The method of claim 4, wherein the analyzing the input data to confirm whether there is the predetermined image pattern in the image corresponding to the input data further comprises:

confirming whether a number of the adjacent pixels, which are adjacent to each other in the pixel row direction and have the grayscale difference greater than the predetermined grayscale, is greater than a predetermined number B.

6. The method of claim 5, wherein the analyzing the input data to confirm whether there is the predetermined image pattern in the image corresponding to the input data further comprises:

confirming whether a number of the adjacent pixels, which are adjacent to each other in the pixel column direction and have the grayscale difference greater than the predetermined grayscale, is greater than a predetermined number C.

7. The method of claim 6, wherein the changing the slew rate of the output buffer of the data driver of the display device based on the result of the analyzing the input data comprises:

lowering the slew rate of the output buffer of the data driver when the number of the adjacent pixels, which are adjacent to each other in the pixel row direction and have the grayscale difference greater than the predetermined grayscale, is greater than the predetermined number B and the number of the adjacent pixels, which are adjacent to each other in the pixel column direction and have the grayscale difference greater than the predetermined grayscale, is greater than the predetermined number C.

8. A display device comprising:

a display area including a plurality of gate lines, a plurality of data lines and a plurality of pixels;

a gate driver which applies a gate voltage to the gate lines;

a data driver which applies a data voltage to the data lines and includes an output buffer; and a signal controller which controls the gate driver and the data driver, wherein the signal controller analyzes input data which is input from outside to confirm whether there is a predetermined image pattern in an image corresponding to the input data, wherein a common voltage is distorted to an extent that a clock signal for the gate driver is distorted when the image including the predetermined image pattern is displayed on the display area, and wherein the signal controller changes a slew rate of the output buffer of the data driver based on a result of analysis on the input data.

9. The display device of claim 8, wherein the signal controller confirms whether adjacent pixels of the pixels, which are adjacent to each other in a pixel row direction or a pixel column direction, have a grayscale difference greater than a predetermined grayscale when the display device displays the image.

10. The display device of claim 9, wherein the signal controller comprises:

an input buffer which receives a gray data of the input data;

a first condition calculator which receives the gray data from the input buffer and determines whether the adjacent pixels, which are adjacent to each other in the pixel row direction, have the grayscale difference greater than a predetermined grayscale;

a second condition calculator which receives the gray data from the input buffer and determines whether the adjacent pixels, which are adjacent to each other in the pixel column direction, have the grayscale difference greater than the predetermined grayscale;

an H-counter which counts a number of the adjacent pixels, which are adjacent to each other in the pixel row direction and have the grayscale difference greater than the predetermined grayscale, based on a result of the first condition calculator;

a V-counter which counts a number of the adjacent pixels, which are adjacent to each other in the pixel column direction and have the grayscale difference greater than the predetermined grayscale, based on a result of the second condition calculator; and a slew rate determining unit which determines the slew based on the number counted by the H-counter and the number counted by the V-counter.

11. The display device of claim 10, wherein the slew rate determining unit decreases the slew rate when the number counted by the H-counter is greater than a first predetermined number, and the number counted by the V-counter is greater than a second predetermined number.

12. The display device of claim 10, wherein the signal controller further comprises a line memory which receives the gray data from the first condition calculator and the second condition calculator and stores the gray data during a predetermined period.

13. The display device of claim 12, wherein the line memory transmits the stored gray data to the second condition calculator.

14. The display device of claim 10, wherein the first condition calculator calculates the following inequality:

$$|Gn(\text{odd})-Gn(\text{even})|>A,$$

wherein Gn(odd) denotes the gray data of an n-th data of the input data sequentially applied to an odd-numbered data line of two adjacent data lines of the data lines, Gn(even) denotes the gray data of the n-th data of the input data sequentially applied to an even-numbered data line of the two adjacent data lines of the data lines, and A denotes a gray value corresponding to the predetermined grayscale.

15. The display device of claim 14, wherein the second condition calculator calculates the following inequality:

$$|\text{Gn(odd)}-\text{Gn}-1(\text{odd})| \text{ or } |Gn(\text{even})-Gn-1(\text{even})|>A,$$

wherein Gn−1(odd) denotes the gray data of an (n−1)-th data of the input data sequentially applied to the odd-numbered data line of the two adjacent data lines of the data lines, and Gn−1(even) denotes the gray data of an (n−1)-th data of the input data sequentially applied to the even-numbered data line of the two adjacent data lines of the data lines.

* * * * *